US010100622B2

(12) United States Patent
Gonzalez

(10) Patent No.: US 10,100,622 B2
(45) Date of Patent: Oct. 16, 2018

(54) AUTONOMOUS FLOW CONTROL DEVICE AND METHOD FOR CONTROLLING FLOW

(71) Applicant: Jose Rafael Gonzalez, Houston, TX (US)

(72) Inventor: Jose Rafael Gonzalez, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 452 days.

(21) Appl. No.: 14/699,444

(22) Filed: Apr. 29, 2015

(65) Prior Publication Data

US 2016/0319634 A1 Nov. 3, 2016

(51) Int. Cl.
*E21B 43/12* (2006.01)

(52) U.S. Cl.
CPC ..... *E21B 43/12* (2013.01)

(58) Field of Classification Search
CPC ..... E21B 43/12; E21B 34/08
See application file for complete search history.

(56) References Cited

U.S. PATENT DOCUMENTS 3,276,480 A * 10/1966 Kennedy ..... F24F 11/047 137/517
3,685,538 A * 8/1972 Sullivan ..... F16K 7/06 137/504
4,092,999 A * 6/1978 Rubrich ..... G05D 7/0133 137/504
4,601,342 A * 7/1986 Pringle ..... E21B 34/08 166/319
6,786,285 B2 9/2004 Johnson et al.
7,870,906 B2 * 1/2011 Ali ..... E21B 34/08 166/320
8,839,993 B2 * 9/2014 Peirsman ..... B67D 1/04 222/394
9,416,637 B2 * 8/2016 Allouche ..... E21B 21/106
2003/0132001 A1 7/2003 Wilson et al.
2010/0294370 A1 * 11/2010 Patterson ..... E21B 23/04 137/1
2015/0053420 A1 2/2015 Fripp et al.
2015/0060084 A1 * 3/2015 Moen ..... E21B 43/12 166/373

OTHER PUBLICATIONS

Aadnoy; "Autonomous Flow Control Valve or "intelligent" ICD"; Hansen Energy Solutions; 2008; 9 pgs.
Autonomous Inflow Control Valve (AICV®) Vidar Mathiesen, BjørnarWerswick and Haavard Aakre (2014), "The Next Generation Inflow Control, the Next Step to IncreaseOil Recovery on the Norwegian Continental Shelf", "SPE 169233"; Society of Petroleum Engineers; 8 pages.

(Continued)

*Primary Examiner* — Matthew R Buck
(74) *Attorney, Agent, or Firm* — Cantor Colburn LLP

(57) ABSTRACT

A flow control device includes a housing; a choke member movably operably positioned at the housing. The member presenting a convex surface positioned to be exposed to a fluid flowing through the flow control device during use. A method for controlling flow through a flow control device.

9 Claims, 3 Drawing Sheets

(56) References Cited

OTHER PUBLICATIONS

Haavard Aakre, Britt Halvorsen, Bjørnar Werswick, Vidar Mathiesen, (2013), Autonomous Inflow Control Valve for Heavy and Extra-Heavy Oil, "SPE 171141"; Society of Petroleum Engineers; 13 pages.
Haavard Aakre, Britt Halvorsen, Bjørnar Werswick, Vidar Mathiesen, (2013), Smart well with autonomous inflow control valve technology, "SPE 164348-MS"; Society of Petroleum Engineers; 8 pages.
Notification of Transmittal of the International Search Report and the Written Opinion of the International Searching Authority, or the Declaration; PCT/US2016/024643; dated Jul. 1, 2016; 10 pgs.
Vidar Mathiesen, Haavard Aakre, BjørnarWerswick, Geir Elseth, Statoil ASA, (2011); The Autonomous RCP Valve—New Technology for Inflow Control in Horizontal Wells,"SPE 145737"; Society of Petroleum Engineers; 10 pages.

* cited by examiner

AUTONOMOUS FLOW CONTROL DEVICE AND METHOD FOR CONTROLLING FLOW

BACKGROUND

In industries where flowing fluids are managed, there is often a need for control of rate of flow. This can be for a large number of reasons. In one example, in downhole industries, flow of fluid into or out of tubular systems disposed downhole can be important to achieving ultimate goals of whatever operation of which the flow of fluids is a part.

Flow control devices, and including inflow control devices, are an example of tools that assist in hydrocarbon production and come presently in many shapes sizes and constructions. Often they will work well for their intended purpose but the industry is always receptive to new configurations that enhance properties or reliability or other salient features of the devices.

BRIEF DESCRIPTION

A flow control device includes a housing; a choke member movably operably positioned at the housing, the member presenting a convex surface positioned to be exposed to a fluid flowing through the flow control device during use.

A flow control device including a housing; a choke member positioned at the housing and configured to automatically move from a flow position to a choked position responsive to fluid flow over the choke member at a velocity exceeding a selected threshold velocity.

A hydrocarbon production system includes a tubular string having an automatic choke member, the member responsive to fluid flowing over a surface of the member at a velocity greater than a selected threshold velocity.

A method for controlling flow through a flow control device includes flowing a fluid through the device; exceeding a selected threshold velocity of flowing fluid; reducing fluid pressure at a choke member; and automatically reducing a flow area by moving the choke member to reduce the flow area.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
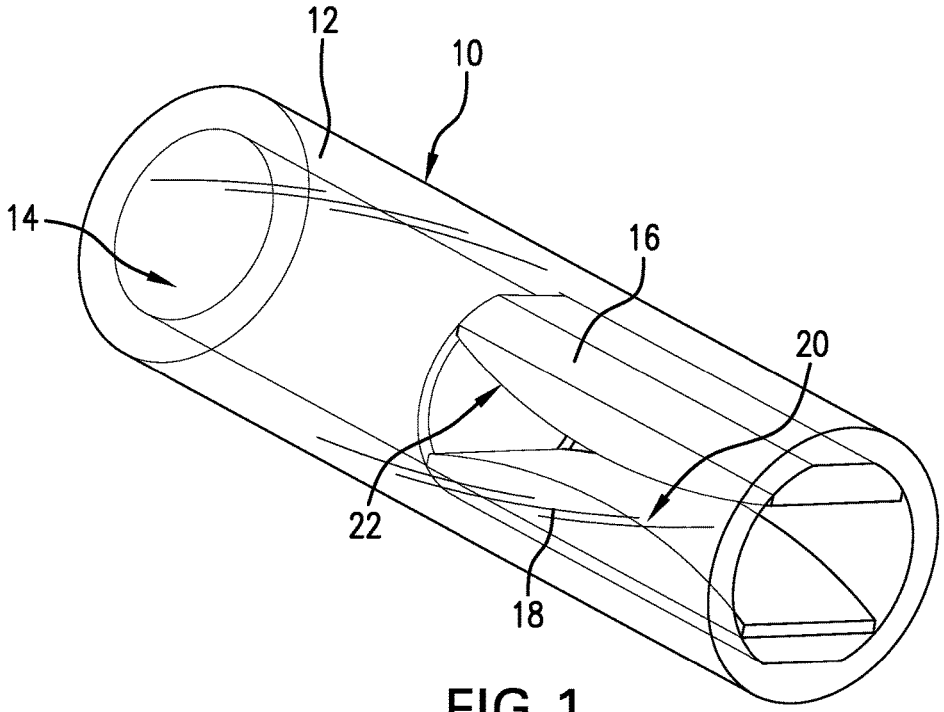
FIG. 1 is a schematic illustration of an autonomous flow control device in accordance with the present disclosure.

Referring to FIG. 1, a flow control device 10, which may be an inflow control device, is illustrated. The device includes a housing 12 that is illustrated with a flow channel

14 although the channel 14 is superfluous to the inventive concept and not necessary. What is important is at least one choke member 16 or 18. Either one of the illustrated choke members can be employed or both can be employed. Where only one of them is employed, the opposite side of the housing 12 may be flat or may present a convex surface. In any of these cases, at least one of the choke members is movable in a direction that reduces an effective flow area between a convex surface of that choke member and a facing surface. As illustrated, two choke members 16 and 18 are shown, each with a convex surface, labeled 20 and 22 respectively. Movement of one or both choke members is toward the other choke member or housing surface in such a way as to reduce the flow area between the choke members. The convexity of at least one of the surfaces 20 and 22 and laminar fluid flow through a flow area between the opposing surfaces causes pressure of the flowing fluid to reduce proportionally to velocity of the fluid flow. Because at least one of the choke members is mobile toward the opposing surface, a higher velocity fluid flow over the choke member will drop pressure on that surface and draw the choke member or choke members depending upon whether one or both are mobile toward the opposing surface. This will reduce the flow area through the device 10. This results in an automatic choking when fluid flow rate increases. The amount of restriction and where on the velocity curve choking occurs is adjustable through the length and slope of the convex surface 20 or 22. Determination of these parameters is left to computational fluid dynamics and finite element analysis based upon such factors as fluid density, solid content, the boundary layer nature, the surface shear stresses and on the regime imposed by the gas/water phases modifying the flow regime. The velocity of sound is calculated locally as a function of the variable-hydraulic-distance separating both fixed or movable surfaces as to establishing the subsonic, sonic and supersonic flow-conditions. Further, the mass of the individual choke members 16 and/or 18 is relevant to the ultimate function of the device. These parameters may be used to determine an appropriate profile for a specific application. Sometimes greater resistance to erosion could be a dictating factor while in other embodiments response time may be of more importance. Generally, a smaller radius curve will produce a more rapid response time while a larger radius curvature will respond less quickly. Likewise a lower mass choke member will respond more quickly while a higher mass choke member will respond less quickly. Advantageously, the device may be constructed of any material be it polymeric, metallic, ceramic, etc. that is appropriate for the fluid that will be encountered during use. No seals are needed and erosion of components of the device 10 is extremely low simply due to the flow type through the device.

Figure 3B:
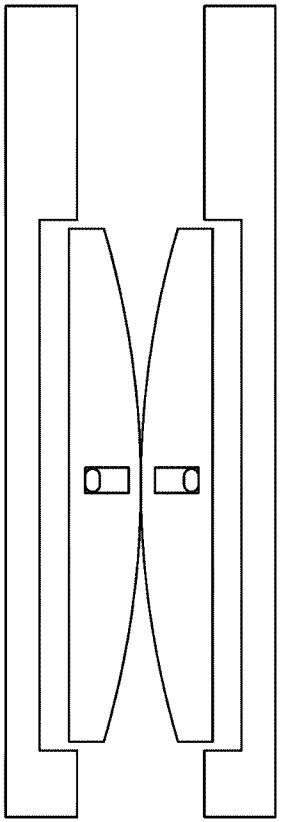
FIGS. 3A and 3B are two schematic views of the same structure in different positions of operation.
Figure 3A:
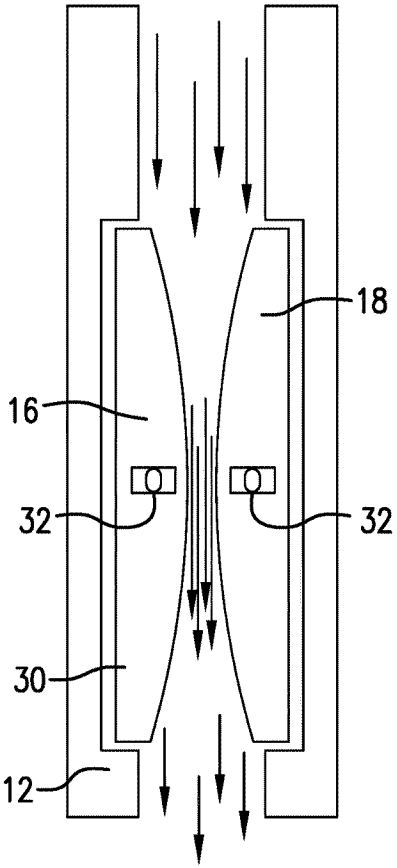

With respect to mobility of the choke member(s) 16 and/or 18, reference is made to FIGS. 3A, B and 4A, B. Each pair of figures shows the same configuration in different positions. FIGS. 3A, B are configured with a recess 30 in the housing 12 for each of the choke members 16 and 18 that are shown. A slide pin 32 ensures the choke member stays in place while allowing the choke member to move radially. One or both of the choke members may be so configured (both being shown as such). FIG. 3B illustrates the configuration after fluid flow has exceeded the design point for velocity and the choke members (both in the illustration) have moved toward the other and reduced the flow area therebetween, thereby automatically choking the device in response to a flow velocity above a selected threshold.

Figure 4B:
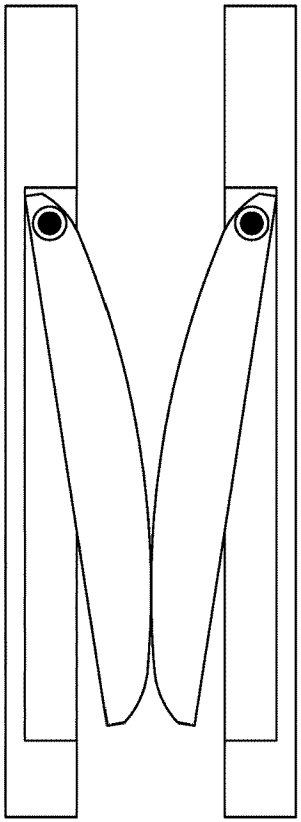
FIGS. 4A and 4B are two schematic views of the same structure in different positions of operation.
Figure 4A:
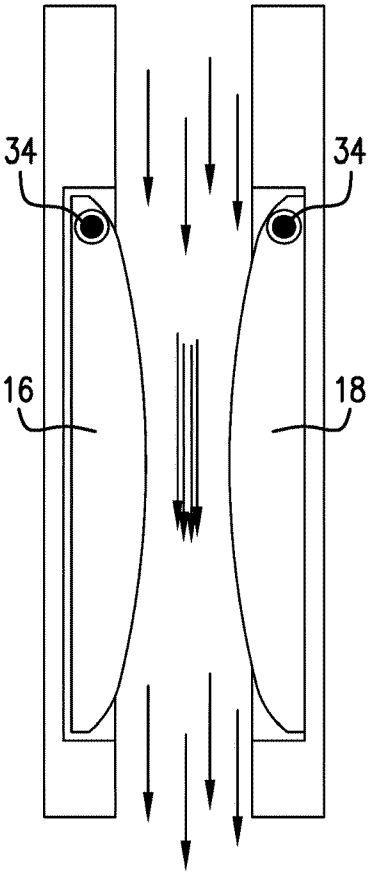

Alternatively, referring to FIGS. 4A and 4B, the choke member(s) are located via pivot pins 34 instead of the slide pins 32, thereby allowing the choke member(s) to pivot rather than move radially. While the movement of the choke member or choke members toward the opposing surface (being another choke member or the housing) occurs differently than in FIGS. 3A, 3B, the same result of a reduced flow area is achieved and this occurs under the same conditions of flow exceeding a design point for movement of the choke member or choke members.

Figure 2:
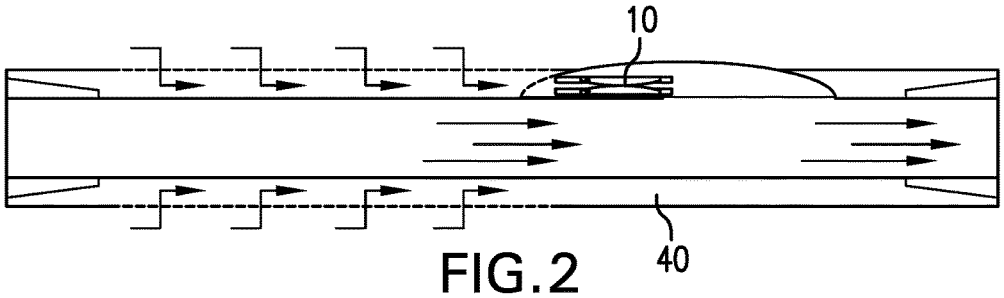
FIG. 2 is a schematic cross section view of the flow control device of FIG. 1 configured as an inflow control device in a tubing string.

While the configurations disclosed will operate well for any fluid conveying apparatus in need of flow regulation, they are particularly suited for use as inflow control devices 10 within a string 40 in a hydrocarbon production system. FIG. 2 illustrates one way in which the devices disclosed herein may be employed in a downhole environment as an inflow control device. Inflow control devices are concerned with controlling rapid inflow of fluid that would allow fingering or coning that is often experienced near the heel of the borehole but can occur in other sections too. Rapid inflow is often associated with water or gas entering the borehole as opposed to oil. Water and gas have a significantly different viscosity than oil and hence will flow faster. The inflow control device as disclosed is advantageous because it will autonomously choke off the flow if the velocity increases, which usually indicates water or gas infiltration.

Figure 5A:
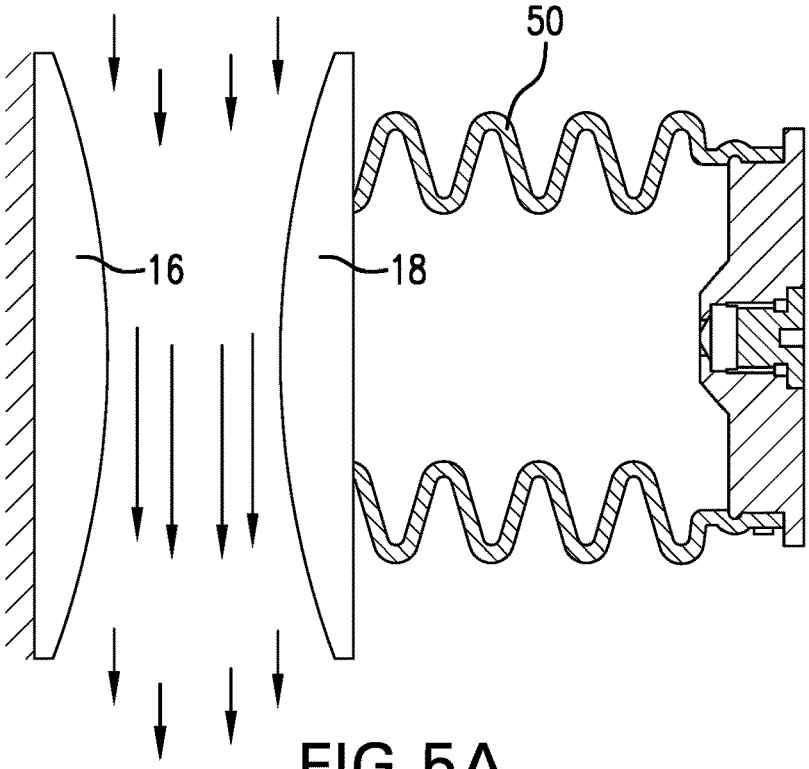
FIGS. 5A and 5B are two schematic views of an alternate embodiment including a spring.
Figure 5B:
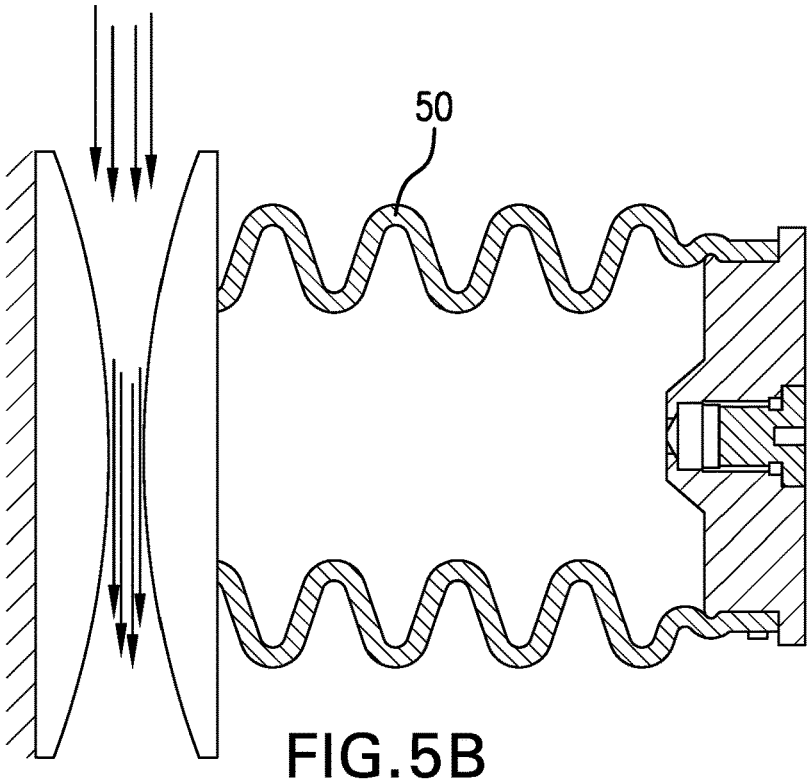

Referring to FIGS. 5A and 5B, an alternate embodiment is illustrated in two conditions of operation. The embodiment employs a resilient member or members 50 (one shown) whose purpose it is to offset the mass of a choke member. In the illustration only one resilient member is shown and is operably connected to one of the choke members . . . in this case choke member 18. It is to be understood however that resilient members may be utilized for both choke members and that one or more than one resilient member may be utilized with each choke member. Further, although FIGS. 5A and 5B use the type of choke members illustrated in FIGS. 3A and 3B, the application of resilient members 50 is equally applicable to the type of choke members illustrated in FIGS. 4A and 4B.

The resilient member acts as a tension spring to help draw the choke member 18 from the position shown in FIG. 5B to the position shown in FIG. 5A after a flow regime that would otherwise cause the choke members to assume the position shown in FIG. 5B (as described above) ceases to exist. This embodiment offsets the mass of the choke member itself so that the device will be more responsive to the flow regime only and not be impeded by the mass of the choke members. In some embodiments like that shown the resilient member is a bellows that is filled with an appropriate fluid for the temperature and other conditions in which the device is to be employed. In other embodiments, other types of springs may be substituted such as metal, rubber, plastic, etc. and in all forms such as coil, leaf, wave, solid, etc. type springs.

A method for controlling flow through a flow control device is also contemplated. The method relies upon the Bernoulli principle and uses a reduction in pressure in a flowing fluid that has exceeded a selected threshold velocity to move the choke member(s) disclosed above in a way that reduces a flow area through the device 10. The movement occurs automatically so that no intervention is needed and so that infinite adjustments occur as fluid flow rates vary over time.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A flow control device comprising:

a housing having a recess therein;

a choke member disposed partially within the recess and movable between a position where the choke member is relatively more within the recess and a position where the choke member is relatively less within the recess, the member presenting a convex surface positioned to be exposed to a fluid flowing through the flow control device during use, the convex surface being arranged to cause fluid flowing over the convex surface at a higher velocity to exhibit a lower pressure than a pressure at a flow rate of lower velocity, the choke member automatically reducing a dimension of a flow area between the convex surface and an opposing surface in response to the lower pressure.

2. The flow control device as claimed in claim 1 wherein the choke member is two choke members each having convex surfaces and wherein the convex surfaces oppose each other.

3. The flow control device as claimed in claim 2 wherein each of the choke members is mobile relative to the housing.

4. The flow control device as claimed in claim 1 wherein the choke member is movable radially.

5. The flow control device as claimed in claim 1 wherein the choke member is movable pivotally.

6. The flow control device as claimed in claim 1 further including a resilient member attached to the choke member and biasing the choke member to a flow position.

7. The flow control device as claimed in claim 1 wherein the choke member presents a venturi causing the lower pressure.

8. A hydrocarbon production system comprising:

a tubular string having an automatic inflow control device including a housing having a recess therein;

a choke member disposed partially within the recess and movable between a position where the choke member is relatively more within the recess and a position where the choke member is relatively less within the recess, the member presenting a convex surface positioned to be exposed to a fluid flowing through the flow control device during use, the convex surface being arranged to cause fluid flowing over the convex surface at a higher velocity to exhibit a lower pressure than a pressure at a flow rate of lower velocity, the choke member automatically reducing a dimension of a flow area between the convex surface and an opposing surface in response to the lower pressure.

9. A method for controlling flow through a flow control device comprising:

flowing a fluid through an inflow control device, the inflow control device including a housing having a recess therein;

a choke member disposed partially within the recess and movable between a position where the choke member is relatively more within the recess and a position where the choke member is relatively less within the recess, the member presenting a convex surface positioned to be exposed to the fluid flowing through the flow control device during use, the convex surface being arranged to cause fluid flowing over the convex surface at a higher velocity to exhibit a lower pressure than a pressure at a flow rate of lower velocity, the choke member automatically reducing a dimension of a flow area between the convex surface and an opposing surface in response to the lower pressure;

exceeding a selected threshold velocity of the flowing fluid;

reducing fluid pressure at the choke member due to the fluid velocity greater than the threshold velocity; and automatically reducing the flow area by moving the choke member to reduce the flow area.

* * * * *